US006577825B1

(12) United States Patent
Gonnella, Jr. et al.

(10) Patent No.: US 6,577,825 B1
(45) Date of Patent: Jun. 10, 2003

(54) USER DETECTION SYSTEM FOR AN IMAGE-FORMING MACHINE

(75) Inventors: Alfred Gonnella, Jr., Rochester, NY (US); Frederick E. Altrieth, III, Scottsville, NY (US); James A. Zimmer, Jr., Rochester, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/692,847

(22) Filed: Oct. 19, 2000

(51) Int. Cl.[7] ..... G03G 15/00; G03G 15/20
(52) U.S. Cl. ..... 399/38; 399/70; 399/75
(58) Field of Search ..... 399/38, 70, 75, 399/80, 67, 69, 76, 77

(56) References Cited

U.S. PATENT DOCUMENTS 4,745,436 A * 5/1988 Matsuura ..... 399/70
5,642,185 A 6/1997 Altreith, III et al.
5,822,077 A * 10/1998 Sasaki et al. ..... 399/38 X

OTHER PUBLICATIONS

User Guide for Xerox 5800/5895/5890 Machines, Xerox Corporation, Apr. 1998.
User Guide for 2100, 2100M, 2100TN HP LaserJet Printers, First Edition, Nov. 1998.
User Guide for 240,255,265DC Xerox Machines, Jun. 1998.

* cited by examiner

*Primary Examiner*—William J. Royer

(57) ABSTRACT

This invention provides an image-forming machine with a user detection system. The image-forming machine has image-forming equipment and at least one sensor. The image-forming equipment may include a photoconductor, one or more chargers, an exposure machine, a toning station, a fusing station, related equipment, and accessories. The image-forming machine may also include a sensor interface and a communication link. The sensor is monitored to detect when a user is near the image-forming machine. An output signal from the sensor indicates a user presence near the image-forming machine. A warm-up procedure is started in response to the output signal of the sensor.

30 Claims, 2 Drawing Sheets

USER DETECTION SYSTEM FOR AN IMAGE-FORMING MACHINE

FIELD OF THE INVENTION

This invention generally relates to image-forming machines having standby operating modes. More particularly, this invention relates to image-forming machines having user detection systems for starting a warm-up procedure from a standby mode.

BACKGROUND OF THE INVENTION

Image-forming machines are used to transfer images onto paper or other medium. Generally, a photoconductor is selectively charged and optically exposed to form an electrostatic latent image on the surface. Toner is deposited onto the photoconductor surface. The toner is charged, thus adhering to the photoconductor surface in areas corresponding to the electrostatic latent image. The toner image is transferred to the paper or other medium. In a fusing station, the paper is heated for the toner to adhere to the paper. The photoconductor is then refreshed or cleaned to remove any residual toner and charged to make it ready for another image.

At start-up and at reactivation from a standby mode, most image-forming machines have a warm-up period to bring various systems and components into a ready-mode for producing images. Many systems and components are ready in a matter of seconds. However, some systems and components may take several minutes to become ready. In many image-forming machines, the warm-up period does not start until the power button is turned-on or the start sequence is activated to begin the image forming process. By that time, a user may have completed one or more preparation steps to begin the image-forming process. The original images may have been placed in an exposure machine. Paper may have been loaded. The image-forming requirements (pages, contrast, etc.) may have been entered. Additional or other preparation steps may have been done. Then, the user usually needs to wait or return to the machine when the warm-up period is finished.

To avoid delays from the warm-up period, the image-forming machine may be maintained in a ready-mode. Under such conditions, the image-forming machine is ready to use whenever desired. However, this approach increases power consumption and maintenance of the image-forming machine. Some systems and components may prematurely wear-out if kept active during extended periods when the image-forming machine is not used.

The fuser station or system typically has two high-temperature heater rollers in contact with a rubber-coated fuser roller. Heater lamps heat the heater rollers. The heater rollers and the fuser roller are in constant rotation whenever the heater lamps are operating. During this rotation, heat transfers from the surface of the heater rollers to the surface of the fuser roller. The heated fuser roller is used to fuse the toned image onto the paper or other medium. If the image-forming machine has an extended period or periods of inactivity, the rotation of the heater and fuser rollers may prematurely wear out various electromechanical devices within the fuser. Other systems and components may be similarly affected by an extended period or periods of inactivity by the image-forming machine.

Accordingly, there is a need to start the warm-up period of an image-forming machine when a user is detected physically near the image-forming machine.

SUMMARY

The invention provides a user detection system for an image-forming machine. The user detection system has at least one sensor to provide an output signal, which is indicative of a user being near the image-forming machine. The image-forming machine starts a warm-up procedure in response to the output signal. The warm-up procedure may start all or part of the systems and components in the image-forming machine. The warm-up procedure also may initially start some of the systems and components, such as the fusing station, and subsequently start the remainder of the image-forming machine.

The image-forming machine may have image forming equipment, which may include a photoconductor, one or more chargers, an exposure machine, a toning station, and a fusing station. The chargers, exposure machine, toning station, and fusing station are positioned adjacent to the photoconductor. The charger electrostatically charges the photoconductor. The exposure machine optically exposes and forms an electrostatic image on the photoconductor. The toning station applies toner on the photoconductor. The toner has a charge to adhere to the electrostatic image. The fusing station heats paper or other medium for the image to adhere to the paper or other medium.

The image-forming machine may have one or more sensors, a sensor interface, and a communication link. The sensors are operatively disposed in one or more sensor operating locations. The sensors are operatively connected via a communication link to a sensor interface. The sensor or sensors provide an output signal to the sensor interface. The output signal is indicative of a user presence near the image-forming machine.

In a method for detecting a user at an image-forming machine having a user detection system, one or more sensors are monitored. The sensors are disposed in one or more sensor operating locations. The activation of the sensors is detected. The activation is indicative of a user presence near the image-forming machine. A warm-up procedure is started for the image-forming machine in response to the activation of the one or more sensors.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

DETAILED DESCRIPTION OF THE PREFERRED EMBODIMENTS

Figure 1:
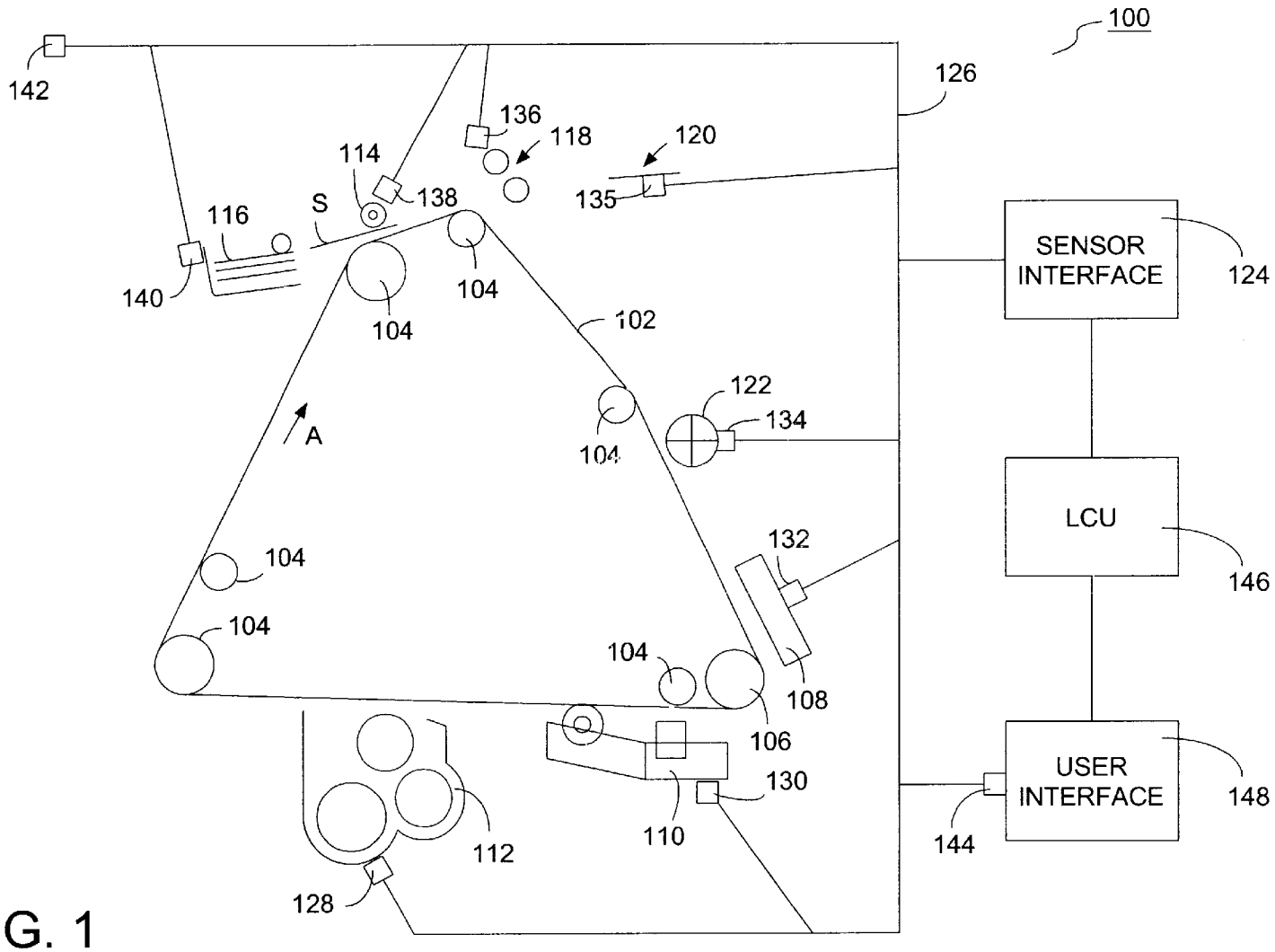
FIG. 1 is a schematic diagram of an image-forming machine having a user detection system.

FIG. 1 is a schematic diagram of an image-forming machine 100 having a user detection system. The image-forming machine 100 includes image-forming equipment and may be a copy machine, a facsimile machine, an electrophotographic image-forming machine, and the like. The image-forming equipment may include a photoconductor 102, support rollers 104, a motor 106, a primary charger 108, an exposure machine 110, a toning station 112, a transfer charger 114, a fusing station 118, a cleaner 122, related equipment, accessories, and the like. The related equipment and accessories may be a paper or media feeder 116, a discharge tray 120, a logic and control circuit (LCU) 146, a user interface 148, an inserter (not shown), a finisher (not shown), a housing (not shown), and the like. The LCU 146 is connected to the user interface 148 and to other components in the image-forming machine 100 (these connections are not shown). While configurations and arrangements are shown for the image-forming machine 100, other configurations and arrangements may be used including those with additional components.

In one aspect, the photoconductor 102 is operatively mounted on the support rollers 104. The motor 106 moves the photoconductor 102 in the direction indicated by arrow A. The primary charger 108, the exposure machine 110, the toning station 112, the transfer charger 114 having the paper or media feeder 116, the fusing station 118 with the discharge tray 120, and the cleaner 122 are operatively disposed adjacent to the photoconductor 102. The feeder 116 is operatively disposed to provide a sheet S of paper or other medium to the transfer charger 114. Multiple sheets may be processed in this manner or the like. The photoconductor 102 preferably has a belt and roller-mounted configuration, but may have a drum or other suitable configuration. The housing supports and protects various components of the image-forming machine 100. These components may be integrated with or part of the housing.

In one aspect, the image-forming machine 100 has a user detection system comprising a sensor interface 124 connected via a communication link 126 to one or more sensors 128, 130, 132, 134, 135, 136, 138, 140, 142, and 144. The user detection system may include one, all, or a combination of the sensors 128, 130, 132, 134, 135, 136, 138, 140, 142, and 144. The user detection system may include other sensors, combinations of other sensors, and combinations of another sensor or sensors with one or more of the sensors 128, 130, 132, 134, 135, 136, 138, 140, 142, and 144. The user detection system may have other configurations suitable for detecting the presence of a user near the image-forming machine.

The sensor interface 124 also connects to the LCU 146. The sensor interface 124 preferably is a microprocessor or the like and may be part of or incorporated with the LCU 146. The sensor interface 124 may be multiple microprocessors, which may be located in multiple positions in the image-forming machine 100. While only one contact point is shown for connection to the communication link 126, the sensor interface 124 may have multiple contact points. The sensor interface 124 is configured to receive the output of the sensors 128, 130, 132, 134, 135, 136, 138, 140, 142, and 144. The output may vary depending upon the sensor or combination of sensors—passive, active, and other variations. The sensor interface 124 may have memory circuitry (not show), for holding the output signal from one or more of the sensors 128, 130, 132, 134, 135, 136, 138, 140, 142, and 144. The sensor interface 124 processes the output signal or signals from the sensors 128, 130, 132, 134, 135, 136, 138, 140, 142, and 144 to provide a net sensor output signal to the LCU 146. The net sensor output signal may be a voltage or other signal identifying that a user is near or beginning to use the image-forming machine 100. The net sensor signal may provide details regarding the sensor or sensors activated and similar information.

The communication link 126 operatively connects the sensors 128, 130, 132, 134, 135, 136, 138, 140, 142, and 144 to the sensor interface 124. The communication link 126 may be a single wire, multiple wires, fiber optics, radio frequency, similar connection devices, and a combination. To avoid overlapping or interfering signals on one wire or similar connection, each of the sensors 128, 130, 132, 134, 135, 136, 138, 140, 142, and 144 may communicate to the sensor interface 124 using different frequency signals, identified signals such as coded signals, and the like. The communication link 126 may be a radio frequency or similar medium, on which each sensor transmits a radio signal to the sensor interface 124. To use a radio frequency, the image-forming machine would need transmitting and receiving devices (not shown). The communication link 126 may be a plurality of wires, in which a single wire connects each of the sensors 128, 130, 132, 134, 135, 136, 138, 140, 142, and 144 to the sensor interface 124. Each of the sensors 128, 130, 132, 134, 135, 136, 138, 140, 142, and 144 may provide an output signal such as an output voltage on a particular wire to the sensor interface 124. The communication link 126 also may be a combination including a single wire for some sensors, multiple wires for other sensors, and another connection device for yet other sensors.

Sensors are operatively disposed at sensor operating locations in the vicinity of the image-forming equipment. A sensor "operatively disposed" is a sensor appropriately positioned or connected to operate according to the sensor type and sensing function. Sensor operating locations in the vicinity of the image-forming equipment may be any location suitable for operation of the sensor with the image-forming equipment. Sensor operating locations may include positions attached or adjacent to individual components and systems, such as chargers, exposure machines, toning stations, and the like. Sensor operating locations in the vicinity of the image-forming equipment may include positions on, under, or incorporated into the housing. Sensor operating locations in the vicinity of the image-forming equipment may include positions outside the image-forming machine.

In one aspect, the sensors 128, 130, 132, 134, 135, 136, 138, 140 are operatively disposed at sensor operating locations adjacent to a particular component or area of the image-forming machine 100. A toning sensor 128 is operatively disposed at the toning station 112. An exposure sensor 130 is operatively disposed at the exposure machine 110. A first charger sensor 132 is operatively disposed at the primary charger 108. A cleaner sensor 134 is operatively disposed at the cleaner 122. A discharge sensor 135 is operatively disposed at the discharge tray 120. A fuser sensor 136 is operatively disposed at the fusing station 118. A second charger sensor 138 is operatively disposed at the transfer charger 114. A feeder sensor 140 is operatively disposed at the paper feeder 116.

The environmental sensor 142 is operatively disposed to sense the environment around the image-forming machine. Preferably, the environmental sensor 142 is positioned to sense the environment within a particular sensing proximity to the image-forming machine 100. An environmental sensor 142 may be a noise sensor, an infrared sensor, or other sensor type to sense the approach of a user, the interactions of a user with the image-forming machine 100, or another activity. The environmental sensor 142 may be voice activated and may be located outside the image-forming machine 100, such as in the room where image-forming machine is located. The sensing proximity is the distance from the image-forming machine 100 where the environmental sensor 142 activates in response to the presence of a user. The sensing proximity depends on the type of sensor and other factors such as the location and the desired operation of the image-forming machine 100. Preferably, the sensing proximity is about two feet.

User interface sensor 144 is operatively disposed to sense user interactions with the user interface 148, such as selecting the paper supply, the number of copies, contrast, and other features. The user interactions may be from a button or touch screen activation, an incoming signal from another microprocessor (such as a personal computer), or other interactive device. In one aspect, the user interface sensor 144 is connected directly to the LCU 146. In another aspect, a signal from the user interface 148 instructs the LCU 146 and signals that a user is present.

The sensors 128, 130, 132, 134, 135, 136, 138, 140, 142, and 144 may be any type of sensing device including sensors activated by weight or mass displacement, light or laser beams, infrared, noise, and motion. The sensors 128, 130, 132, 134, 135, 136, 138, 140, 142, and 144 may be passive or active sensing devices. A passive sensing device provides an output signal when a circuit or connection is completed. There is no output signal until the connection is made. However, there may be a control or set point signal for maintaining communication or referencing the output signal to the sensor interface 124. In a passive weight displacement sensor, there may be no output signal until sufficient weight activates the sensor. The output signal may vary with changes in weight. An active sensing device stops providing an output signal when a circuit or connection is broken. In an active light beam sensor, the sensor provides an output signal until the light beam is broken. Similarly, there may be active weight displacement sensors and passive light beam sensors. Some sensors may be both passive and active.

Different types of sensors may be used individually and in combination for the same function. A weight displacement sensor for the paper feeder 116 may be disposed under a feeder tray (not shown) to sense the weight of the paper. A light or laser beam sensor for the paper feeder 116 may be disposed for the beam to cross an opening to sense paper when it is placed in the paper tray. Additionally, a single sensor may be positioned for multiple components of the image-forming machine 100. A noise sensor may be disposed to sense opening sounds of access panels for the exposure machine 110, toning station 112, and the paper feeder 116. While multiple sensors are shown, the image-forming machine 100 may have only one sensor, may have another sensor or sensors, and other combinations of sensors.

In addition, any of the sensors 128, 130, 132, 134, 135, 136, 138, 140, 142, and 144 may comprise a sensor sub-network (not shown) for a particular component or area of the image-forming machine 100. A sensor sub-network includes a plurality of sensors (not shown) and may have a sub-microprocessor (not shown) connected to the sensor interface 124 or the LCU 146. The paper feeder sensor 140 may comprise a weight displacement sensor (not shown) under a paper tray (not shown) of the paper feeder 116 and a contact sensor (not shown) connected to a latch for the paper tray. Activation of either the weight displacement sensor or the contact sensor indicates a user is near the image-forming machine 100. The environment sensor 142 may have multiple proximity sensors (not shown) disposed on the perimeter of the image-forming machine 100.

In one standby mode, the image-forming machine 100 may be activated for use. After a period of non-activity, the image-forming machine 100 is placed into a standby mode. Most of the systems and components in the image-forming machine 100 are powered down or shut-off. The fusing station 118 may be shutdown so the heating lamps and rollers are not operating. At least, the LCU 146, the sensor interface 124, sensors 128, 130, 132, 134, 135, 136, 138, 140, 142, and 144, and support equipment (e.g., cooling fans, power supply, etc.) remain operating. In another standby mode, the image-forming machine 100 is not activated for use. However, at least the LCU 146, the sensor interface 124, and sensors 128, 130, 132, 134, 135, 136, 138, 140, 142, and 144, and support equipment (e.g., cooling fans, power supply, etc.) are operating. Other standby modes may be used. A standby mode may have multiple stages such as an "almost shutdown" stage (the LCU 146, the sensor interface 124, sensors 128, 130, 132, 134, 135, 136, 138, 140, 142, and 144, and support equipment are operating), a "fuser shutdown" stage (the fuser station 118 is not operating), and the like.

The sensor interface 124 and the LCU 146 monitor the output of the sensors 128, 130, 132, 134, 135, 136, 138, 140, 142, and 144. When one or more of the sensors 128, 130, 132, 134, 135, 136, 138, 140, 142, and 144 are activated, the sensor interface 124 relays an output signal or signals to the LCU 146. The activation of the sensors 128, 130, 132, 134, 135, 136, 138, 140, 142, and 144 is indicative of a user being near the image-forming machine. The output signal or signals may include output from both active and passive sensors. The LCU 146 may activate the entire image-forming machine 100 into the ready-mode. The LCU 146 may partially activate or stage the activation of the image-forming machine 100 into the ready-mode. The LCU 146 may activate the fusing station 118 initially and then may activate the remainder of the image-forming machine at a later time. The LCU 146 may provide sensor status output to the user interface 148 for display.

After partial or complete activation of the image-forming machine 100, the LCU 146 may deactivate or place the image-forming machine 100 into a "sleep" or standby mode if the image-forming process is not started within a predetermined time period. The predetermined time period may be any length of time and may depend upon the cause of the activation and the frequency of previous activations. The predetermined time period may vary and may be changed by the user. In one aspect, the predetermined time period is two minutes. The LCU 146 may deactivate the entire image-forming machine 100. The LCU 146 may partially deactivate or stage the deactivation of the image-forming machine 100. The LCU 146 may deactivate the fusing station 118 after initially deactivating other portions of the image-forming machine 100.

In one aspect, a user is near the image-forming machine 100 when the user physically attempts to use or uses the image-forming machine 100. A user may be near when physically close or physically approaching the location of the image-forming machine 100. A user may be near when standing next to the image-forming machine 100. A user may be near when interacting with the image-forming machine 100 such as adding paper, positioning an image, interacting with a user interface as when inputting job requirements, and the like.

A user may be near the image-forming machine 100 when the user is near a remote communication device (not shown) for accessing and controlling the image-forming machine 100. A remote sensor may be operatively disposed in a sensor operating position in the vicinity of the remote communication device. The remote sensor may sense movement and touching of the remote communication device. The remote communication device may be a personal computer, a portable control unit, and the like. The remote communication device may be operatively connected to the image-forming equipment via a wire, a radio frequency, or another suitable communication link.

The sensor interface 124 and the LCU 146 may have a logic control (not shown) to provide a response to the output signal or signals from the sensors 128, 130, 132, 134, 135, 136, 138, 140, 142, and 144. In one aspect, the logic control activates the warm-up procedure for the image-forming machine 100 when any of the sensors 128, 130, 132, 134, 135, 136, 138, 140, 142, and 144 provides an output signal or signals. In another aspect, the logic control evaluates the output signal or signals. The logic control may delay the warm-up procedure until a second signal is received. The second signal may confirm that a particular event or a second event has occurred. The logic control may delay the warm-up procedure when a first output signal from the toning station 112 indicates an access panel (not shown) is opened. Subsequently, the logic control may start the warm-up procedure when a second output signal from the toning station 112 indicates the access panel (not shown) is closed. The logic control may shutdown part or the entire image-forming machine 100 when a particular sensor or particular sensors are activated. The logic control may delay starting the image forming process when a particular sensor or particular sensors are activated.

Figure 2:
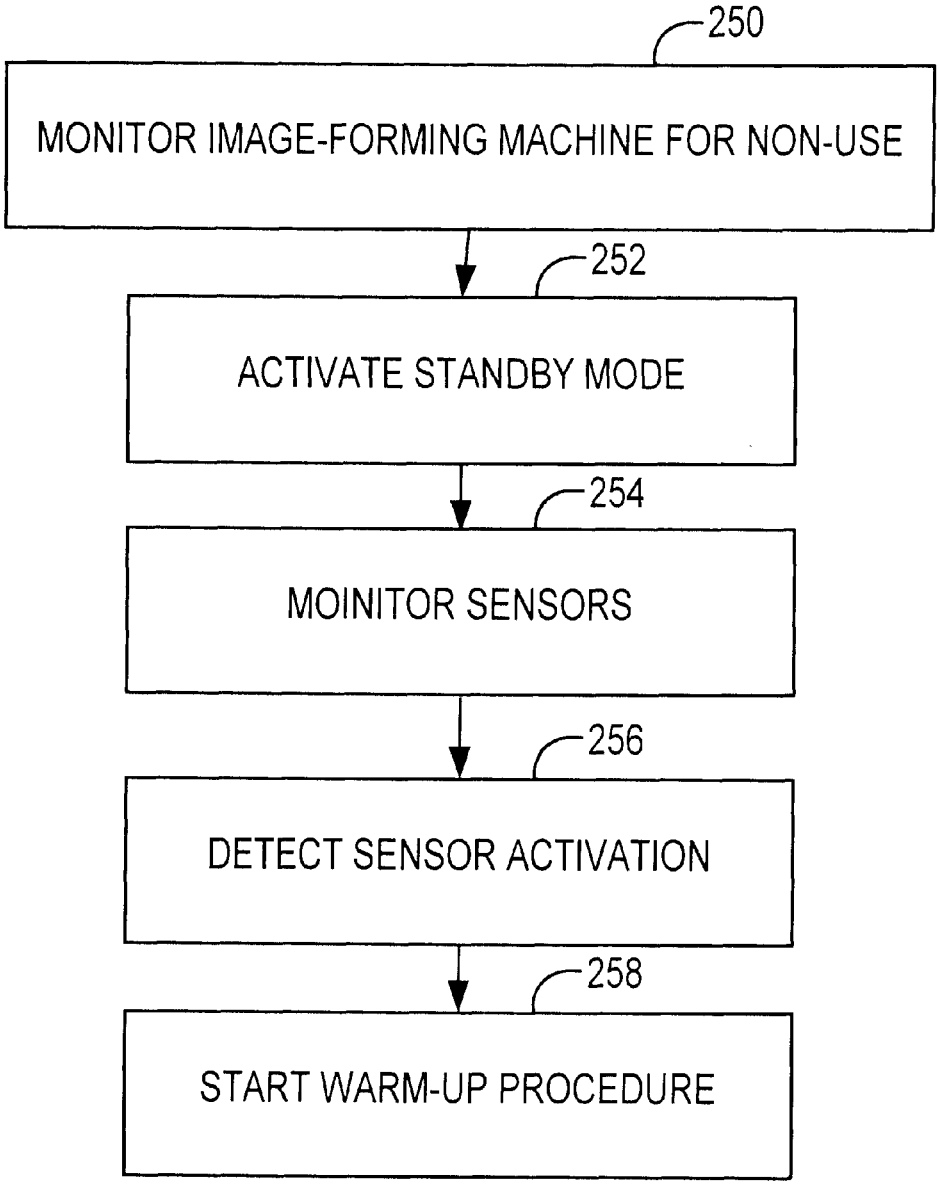
FIG. 2 is a flowchart of a method for detecting a user at an image-forming machine.

FIG. 2 is a flowchart of a method for detecting a user at an image-forming machine. As discussed, the image-forming machine is monitored 250 for non-use. After a period of non-use, a standby mode is activated 252 for the image-forming machine. The standby mode may shutdown the entire image-forming machine except for the logic and control unit (LCU), support equipment (power supplies, cooling fans, and the like), and a user detection system comprising a sensor interface and one or more sensors operatively disposed on the image-forming machine. The standby mode may shutdown only part of the image-forming machine such as the fusing station. The standby mode may be activated in stages such as shutting down the fusing station initially and then other systems and components later. The one or more sensors are monitored 254. The activation of one or more of the sensors is detected 256. The activation indicates the presence of a user near the image-forming machine. The presence of a user may be indicated by the opening of an access panel, the pushing of buttons or a touch screen, the placement of paper, the noise and heat associated with the presence of a user, and the like as previously discussed. The warm-up procedure for the image-forming machine is started 258. In one aspect, the entire image-forming machine is started. In another aspect, part of the image-forming machine is started initially and the remainder of the image-forming machine is started at a later time or upon another sensor activation. The fusing station may be started upon a first sensor activation and other systems or components started at a later time or upon another sensor activation.

Various embodiments of the invention have been described and illustrated. However, the description and illustrations are by way of example only. Many more embodiments and implementations are possible within the scope of this invention and will be apparent to those of ordinary skill in the art. Therefore, the invention is not limited to the specific details, representative embodiments, and illustrated examples in this description. Accordingly, the invention is not to be restricted except in light as necessitated by the accompanying claims and their equivalents.

What is claimed is:

1. An image-forming machine with a user detection system, comprising:

image forming equipment comprising a photoconductor, at least one charger, wherein the at least one charger is disposed to electrostatically charge the photoconductor, an exposure machine wherein the exposure machine is operatively disposed to optically expose and form an electrostatic image on the photoconductor, a toning station, wherein the toning station is operatively disposed to apply toner on the photoconductor, the toner having a charge to adhere to the electrostatic image;

at least one first sensor operatively disposed in at least one first sensor operating location in the vicinity of the image forming equipment, at least one second sensor operatively disposed at, at least one of the at least one charger and the toning station;

the at least one first and second sensors provide output signals in response to a user presence near the image-forming machine; and wherein the at least one charger, the exposure machine, and the toning station are activated in response to the output signals.

2. An image-forming machine according to claim 1, where the image-forming machine comprises a fuser station operatively disposed adjacent to the photoconductor, where the fuser station is activated based on the output signals.

3. An image-forming machine according to claim 1, further comprising a sensor interface to receive the output signals; and a communication link operatively connecting the at least one first sensor and the at least one second sensor to the sensor interface.

4. An image-forming machine according to claim 3, further comprising a logic and control unit connected to receive a net sensor output signal from the sensor interface, the net sensor output signal based on the output signals.

5. An image-forming machine according to claim 4, where the logic and control unit starts a warm-up procedure based on the net sensor output signal.

6. An image-forming machine according to claim 4, where the sensor interface and the logic and control unit are the same microprocessor.

7. An image-forming machine according to claim 3, where the communication link is at least one of a wire, a plurality of wires, and a radio frequency.

8. An image-forming machine according to claim 1, where the at least one first sensor is at least one of a passive detecting device and an active detecting device.

9. An image-forming machine according to claim 1, where the at least one first sensor comprises an environmental sensor.

10. An image-forming machine according to claim 9, where the environmental sensor is operatively disposed in a sensor operating area to detect a user within a sensing proximity of the image-forming machine.

11. An image-forming machine according to claim 10, where the sensing proximity is about two feet.

12. An image-forming machine according to claim 1, comprising a sub-microprocessor connected to receive output signals from the at least one first sensor and the at least one second sensor, the sub-microprocessor to provide a network output signal to a sensor interface.

13. An image-forming machine according to claim 1, where the image-forming equipment is deactivated after a predetermined time period.

14. An image-forming machine according to claim 1, further comprising a remote communication device operatively connected to the image-forming equipment, the remote communication device to access and control the image-forming equipment, where the at least one first sensor includes a remote sensor operatively disposed in a sensor operating location in the vicinity of the remote communication device.

15. A method for detecting a user near an image-forming machine having a user detection system, comprising:

(a) monitoring at least one sensor disposed in at least one sensor operating location comprising:

(a1) monitoring the image-forming machine for a period of non-use:

(a2) activating a standby mode for the image-forming machine and shutting down a fuser station in the image-forming machine;

(b) detecting activation of the at least one sensor, the activation indicative of a user presence near the image-forming machine; and (c) starting a warm-up procedure for the image-forming machine and activating the fuser station in response to the activation of the at least one sensor.

16. A method for detecting a user near an image-forming machine according to claim 15, where substep (a2) further comprises leaving the at least one sensor operating.

17. A method for detecting a user near an image-forming machine according to claim 15, where substep (a2) further comprises shutting down part of the image-forming machine initially and a remainder of the image-forming machine subsequently.

18. A method for detecting a user near an image-forming machine according to claim 15, where step (b) further comprises the substep:

(b1) providing an output signal from the at least one sensor to a sensor interface.

19. A method for detecting a user near an image-forming machine according to claim 18, where substep (b1) further comprises providing a net sensor output signal from the sensor interface to a logic and control circuit, the net sensor output signal based on the output signal.

20. A method for detecting a user near an image-forming machine according to claim 19, where, in step (c), the logic and control circuit starts the warm-up procedure based on the net sensor output signal.

21. A method for detecting a user near an image-forming machine according to claim 15, where step (c) further comprises starting part of the image-forming machine initially and starting a remainder of the image-forming machine subsequently.

22. A method for detecting a user near an image-forming machine according to claim 15, further comprising the step:

(d) deactivating the image-forming machine after a predetermined time period.

23. An image-forming machine with a user detection system, comprising:

image-forming equipment comprising:

a photoconductor:

a fuser station operatively disposed adjacent to the photoconductor; and at least one sensor operatively disposed in at least one sensor operating location in the vicinity of the image-forming equipment, the at least one sensor to provide an output signal in response to a user presence near the image-forming machine, where at least part of the image-forming equipment begins a warm-up procedure and where the fuser station is activated in response to the output signal.

24. An image-forming machine with a user detection system, comprising:

image-forming equipment comprising:

a photoconductor:

a fuser station operatively disposed adjacent to the photoconductor;

at least one sensor is disposed at the fuser station, the at least one sensor provides an output signal in response to a user presence near the image-forming machine; and wherein at least part of the image-forming equipment begins a warm-up procedure and where the fuser station is activated in response to the output signal.

25. An image-forming machine with a user detection system, comprising:

image-forming equipment: and at least one sensor operatively disposed in at least one sensor operating location in the vicinity of the image-forming equipment, wherein the at least one sensor monitors the image-forming equipment for a period of non-use, where the image-forming equipment activates a standby mode as a response to the non-use, where the standby mode is when a fusing station in the image-forming equipment is in a shut-down mode and other portions of the image-forming equipment are still active.

26. An image-forming machine according to claim 25, wherein the fusing station is activated as a response to the at least one sensor providing an output signal response to a user presence near the image-forming machine.

27. An image-forming machine according to claim 26, wherein the fusing station activated is a partial activation of the image-forming machine where the other portions of the image-forming machine are not activated.

28. A method for detecting a user near an image-forming machine having a user detection system, comprising:

(a) monitoring at least one sensor disposed in at least one sensor operating location comprising:

(b) monitoring the image-forming machine for a period of non-use; and (c) activating a standby mode for the image-forming machine where portions of the image-forming machine are active and shutting down a fuser station in the image-forming machine.

29. A method for detecting a user near an image-forming machine according to claim 28, further comprises detecting activation of the at least one sensor, the activation indicative of a user presence near the image-forming machine; and activating the fuser station in response to the user presence near the image-forming machine.

30. A method for detecting a user near an image-forming machine according to claim 29, wherein the fuser station activated is a partial activation of the image-forming machine where the portions of the image-forming machine are not activated.

* * * * *